US010145096B2

(12) United States Patent
Kashirajima et al.

(10) Patent No.: US 10,145,096 B2
(45) **Date of Patent: *Dec. 4, 2018**

(54) FLUSH TOILET HAVING A RIM SPOUT STRUCTURE

(71) Applicant: TOTO LTD., Kitakyushu-shi, Fukuoka (JP)

(72) Inventors: Shu Kashirajima, Kitakyushu (JP); Masaaki Momoe, Kitakyushu (JP); Yuki Shimokawa, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/450,342

(22) Filed: Mar. 6, 2017

(65) Prior Publication Data

US 2017/0260731 A1 Sep. 14, 2017

(30) Foreign Application Priority Data

Mar. 9, 2016 (JP) ..... 2016-045834

(51) Int. Cl.
*E03D 9/08* (2006.01)
*E03D 11/08* (2006.01)

(52) U.S. Cl.
CPC ..... *E03D 11/08* (2013.01); *E03D 9/08* (2013.01)

(58) Field of Classification Search
CPC ..... E03D 11/08; E03D 11/02; E03D 9/08; E03D 2201/40; E03D 2201/20; E03D 2201/00
USPC ..... 4/420
See application file for complete search history.

(56) References Cited

U.S. PATENT DOCUMENTS 705,319 A * 7/1902 Bush ..... E03D 11/02 4/420
1,177,384 A * 3/1916 Cochran ..... E03D 11/08 4/425
2004/0040080 A1* 3/2004 Prokopenko ..... E03D 1/34 4/420
2006/0005310 A1* 1/2006 Nakamura ..... E03D 11/08 4/420
2013/0019391 A1* 1/2013 Yoneda ..... E03D 11/08 4/421
2013/0047326 A1* 2/2013 Yamasaki ..... E03D 11/08 4/345
2013/0047329 A1* 2/2013 Yamasaki ..... E03D 11/02 4/420

(Continued)

*Primary Examiner* — Benjamin R Shaw
(74) *Attorney, Agent, or Firm* — Brooks Kushman P.C.

(57) ABSTRACT

A flush toilet includes a bowl having a waste-receiving surface and a rim; on either the left or right side inside the front area of this bowl, a rim water passageway is formed and a rim spouting port is formed; the water passageway formed at the downstream side of this rim spouting port forms a flow path cross section with the inner circumferential surface of the rim, the shelf surface formed under this inner circumferential surface, and the overhang portion formed over the inner circumferential surface; the height dimension of the flow path cross section is set to increase with distance on the downstream side, and the width thereof is set to decrease with distance on the downstream side, so that from the rim spout port toward the downstream side, the cross sectional area of the flow path cross section is approximately constant.

8 Claims, 12 Drawing Sheets

(56) References Cited

U.S. PATENT DOCUMENTS

| | | | | |
|---|---|---|---|---|
| 2014/0130246 | A1* | 5/2014 | Wu | E03D 11/02 4/420 |
| 2014/0289947 | A1* | 10/2014 | Hirakawa | E03D 11/08 4/421 |
| 2015/0275494 | A1* | 10/2015 | Kashirajima | E03D 11/02 4/420 |

* cited by examiner

FLUSH TOILET HAVING A RIM SPOUT STRUCTURE

CROSS-REFERENCE TO RELATED APPLICATIONS

This application claims priority to JP application JP 2016-045834 filed on, Mar. 9, 2016, the disclosure of which is incorporated in its entirety by reference herein.

TECHNICAL FIELD

The present invention relates to a flush toilet, and more particularly to the flush toilet for discharging waste with flush water supplied from a flush water source.

BACKGROUND

Flush toilets for discharging waste by flushing with flush water supplied from a flush water source have been known for some time in which, as noted in Patent Document 1 (Japanese Patent Unexamined Publication No. 2013-44177, for example, the rim spout port of a rim water passageway for forming a circulating flow by spouting flush water onto the shelf portion of a bowl is formed in the front area of the bowl, and a portion only of the rim inner circumferential surface is formed as an inward overhang in the water passageway immediately behind this rim spout port.

In addition, as noted in Patent Document 2 (Japanese Patent No. 5483314 (Japanese Patent Unexamined Publication No. 2011-12508)), flush toilets are also known in which the dimension in the vertical direction of the rim passage formed on the top edge of the bowl is set to become gradually smaller toward the downstream side.

However in conventional flush toilets set forth in the above-described Patent Documents 1 and 2, the cross sectional area of the water passing cross section in the water passageway formed at the downstream side of the rim spouting port is not set to be constant from the rim spout port toward the downstream side, therefore when the height of the water passage cross section on the downstream side of the rim spouting port is set to increase with distance downstream, there is a risk of turbulence in the rim spout water passing through the water passage cross section, and of flush water splashing.

Another problem is that visibility and cleanability of the water passageway on the downstream side of the rim spouting port degrades more as the area of the overhang portion covering the water passageway on the downstream side of the rim spouting port increases.

SUMMARY

The present invention was undertaken to solve the above-described problems with the conventional art, and has the object of providing a flush toilet with which splashing of flush water spouted from a rim spouting port can be prevented, and the visibility and cleanability of the water passageway on the downstream side of the rim spouting port can be effectively increased.

To achieve the above-described object, the present invention is a flush toilet for discharging waste with flush water supplied from a flush water source, the flush toilet comprising: a bowl including a bowl-shaped waste receiving surface and a rim formed at a top edge of the waste receiving surface; a discharge path connected at a bottom of the bowl to discharge waste; a rim spout portion disposed on the rim, the rim spout portion being configured to spout the flush water into the bowl so as to form a circulating flow; and a water conduit configured to supply the flush water supplied from the flush water source to the rim spout portion; wherein the bowl includes a front region on a front side relative to a center line and a rear region on a rear side relative to the center line, the center line being extending in a left-right direction to equally divide the bowl in the front-rear direction; and wherein the rim spout portion includes a rim water passageway on the rim at either a left side or a right side within the front region of the bowl so as to pass the flush water supplied from the water conduit; and a rim spout port at a downstream end of the rim water passageway so as to spout the flush water rearward; and wherein a water passageway formed on a downstream side of the rim spouting port forms a flow path cross section with an inner circumferential surface of the rim, a shelf surface formed under the inner circumferential surface, and an overhang portion formed over the inner circumferential surface; and wherein a height dimension of the flow path cross section of the water passageway is set to increase with a downstream side distance from the rim spout port, and a width of the flow path cross section of the water passageway is set to decrease with the downstream side distance from the rim spout port, so that the cross sectional area of the flow path cross section is approximately constant from the rim spout port toward the downstream side.

According to the invention thus constituted, the rim water passageway formed on the downstream side of the rim spouting port forms a flow path cross section of the rim inner circumferential surface, the shelf surface formed at the bottom side of this rim inner circumferential surface, and an overhang portion formed on the top side of the inner circumferential surface; and the water passageway is arranged so that the height dimension of the flow path cross section is set to increase with distance on the downstream side, and the width of the flow path cross section is set to decrease with distance on the downstream side, so that from the rim spout port toward the downstream side, the cross sectional area of the flow path cross section is approximately constant; by so doing, rim spout water passing through the flow path cross section of the water passageway on the downstream side of the rim spouting port after being spouted from the rim spout port is able to flow to the downstream side along the interior of the water passageway, turbulence suppressed, so that a stable circulating flow can be effectively formed inside the bowl on the downstream side.

With flush water spouted from the rim spouting port, a stable flow can be formed on the downstream side matching the water passageway on the downstream side thereof, thereby preventing flush water from splashing, so that bowl visibility and cleanability can be effectively improved.

Note that "cross sectional area is approximately constant" means not only completely constant, but also approximately constant, whereby rim spout water passing through the flow path cross section of the water passageway on the downstream side of the rim spouting port after being spouted from the rim spouting port is able to flow along the inside of the water passageway on the downstream side with turbulence suppressed, so that a stable circulating flow can be effectively formed inside the bowl on the downstream side.

In the present invention, preferably, the shelf surface forming the flow path cross section is formed so that a height position of the shelf surface is at an approximately constant height position from the rim spouting port toward the downstream side.

According to the invention thus constituted, the height position of the shelf surface forming the flow path cross section of the water passageway formed on the downstream side of the rim spouting port is formed to have an approximately constant height position, from the rim spouting port toward the downstream side; by so doing, rim spout water passing through the flow path cross section of the water passageway on the downstream side of the rim spouting port after being spouted from the rim spouting port is able to flow to the downstream side along the inside of the water passageway with turbulence suppressed, so that a stable circulating flow can be more effectively formed on the downstream side.

With flush water spouted from the rim spouting port, a stable flow can be formed on the downstream side matching the water passageway on the downstream side thereof, thereby preventing flush water from splashing, so that bowl visibility and cleanability can be more effectively improved.

Note that "approximately constant height position" here means not only completely constant, but also approximately constant, whereby rim spout water passing through the flow path cross section of the water passageway on the downstream side of the rim spouting port after being spouted from the rim spouting port is able to flow to the downstream side along the inside of the water passageway with turbulence suppressed, so that a stable circulating flow can be effectively formed on inside the bowl on the downstream side.

In the present invention, preferably, the overhang portion forming the flow path cross section is formed so that a height position of the overhang portion is at an approximately constant height position from the rim spouting port toward the downstream side.

According to the invention thus constituted, the height position of the overhang portion forming the flow path cross section of the water passageway formed on the downstream side of the rim spouting port is formed to have an approximately constant height position, from the rim spouting port toward the downstream side; by so doing, rim spout water passing through the flow path cross section of the water passageway on the downstream side of the rim spouting port after being spouted from the rim spouting port is able to flow to the downstream side along the inside of the water passageway with turbulence suppressed, so that a stable circulating flow can be more effectively formed on the downstream side.

With flush water spouted from the rim spouting port, a stable flow can be formed on the downstream side matching the water passageway on the downstream side thereof, thereby preventing flush water from splashing, so that bowl visibility and cleanability can be more effectively improved.

Note that "approximately constant height position" means not only completely constant, but also approximately constant, whereby rim spout water passing through the flow path cross section of the water passageway on the downstream side of the rim spouting port after being spouted from the rim spouting port is able to flow to the downstream side along the inside of the water passageway with turbulence suppressed, and is able to effectively form a stable circulating flow inside the bowl on the downstream side.

In the present invention, preferably, a ratio (U:L) of a minimum height dimension (U) of the overhang portion in the flow path cross section to the maximum height dimension (L) from the shelf surface to a bottom edge of the overhang portion is set between 1:6 and 6:1.

According to the invention thus constituted, because the ratio (U:L) of the minimum height dimension (U) of the overhang portion in the upstream cross section to the maximum height dimension (L) from the shelf surface to the bottom edge of the overhang portion is set between 1:6 and 6:1, rim spout water passing through the flow path cross section of the water passageway on the downstream side of the rim spouting port after being spouted from the rim spouting port is able to flow to the downstream side along the inside of the water passageway with turbulence suppressed, and is able to effectively form a stable circulating flow inside the bowl on the downstream side.

With flush water spouted from the rim spouting port, a stable flow can be formed on the downstream side matching the water passageway on the downstream side thereof, thereby preventing flush water from splashing, so that bowl visibility and cleanability can be even more effectively improved.

In the present invention, preferably, a cross section of the rim spouting port is formed in a triangular shape, and one side of the triangular shape of the rim spouting port forms the overhang portion.

In the invention thus constituted, the opening cross section of the rim spouting port is formed in a triangular shape, and one side of this triangular rim spouting port forms the overhang portion; by so doing, the overhang portion area can be made smaller compared, for example, to a rim spouting port in which the opening cross section is formed in a rectangular shape, and has the same width as the width of the opening cross section of the triangular rim spouting port.

Therefore rim spout water passing through the flow path cross section of the water passageway on the downstream side of the rim spouting port after being spouted from the rim spouting port is able to flow to the downstream side along the inside of the water passageway with turbulence suppressed, and is able to effectively form a stable circulating flow inside the bowl on the downstream side.

With flush water spouted from the rim spouting port, a stable flow can be formed on the downstream side matching the water passageway on the downstream side thereof, thereby preventing flush water from splashing, so that bowl visibility and cleanability can be even more effectively improved.

With the flush toilet of the present invention, for flush water spouted from a rim spouting port, flush water splashing can be prevented, and visibility and cleanability of the water passageway on the downstream side of the rim spouting port can be effectively improved.

DETAILED DESCRIPTION

Next, referring to FIGS. 1 through 13, a flush toilet according to the first embodiment of the invention is explained.

Figure 1:
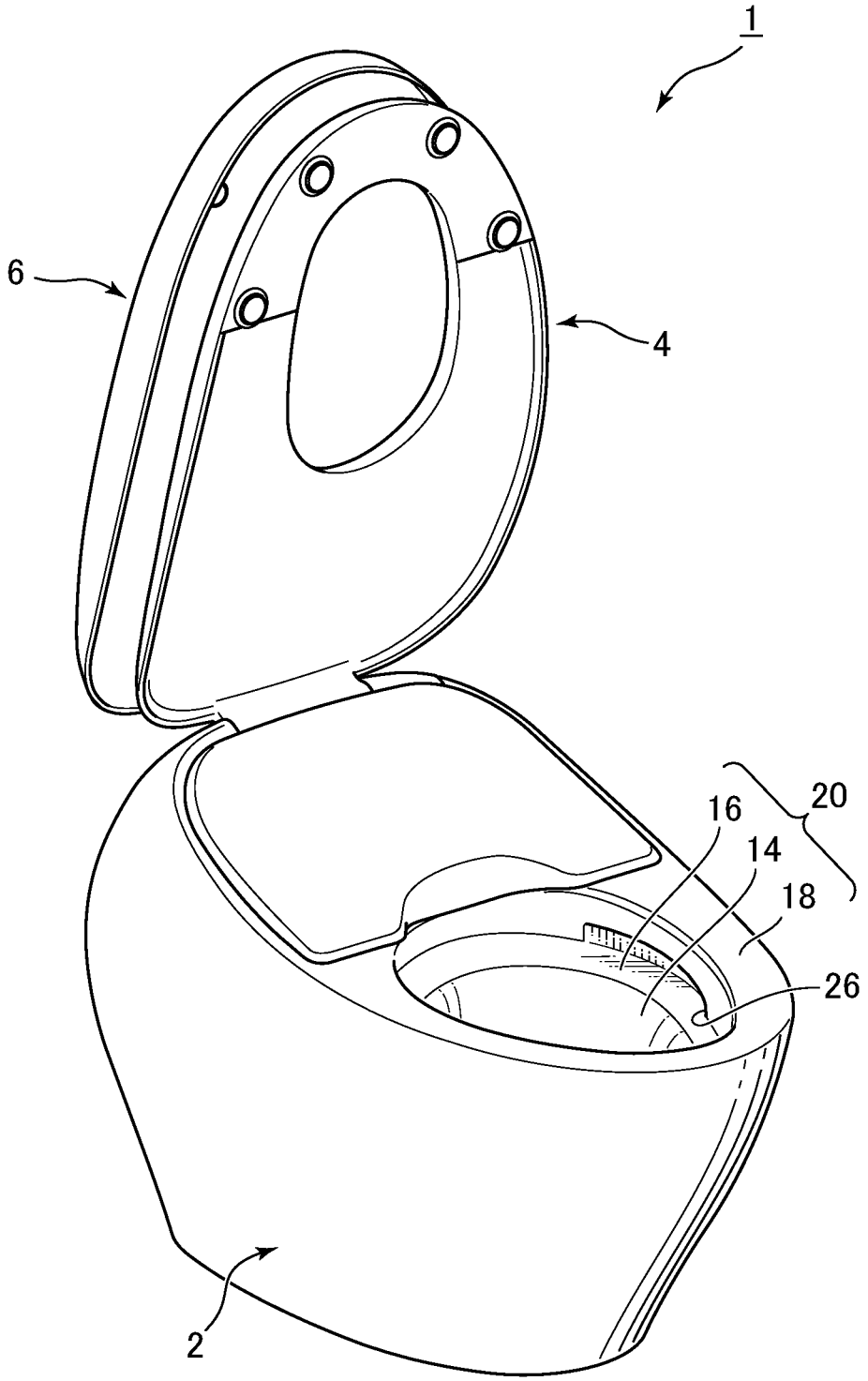
FIG. 1 is a perspective view showing a flush toilet according to a first embodiment of the invention, in a state whereby the toilet lid and toilet seat are rotated up to an up position.
Figure 2:
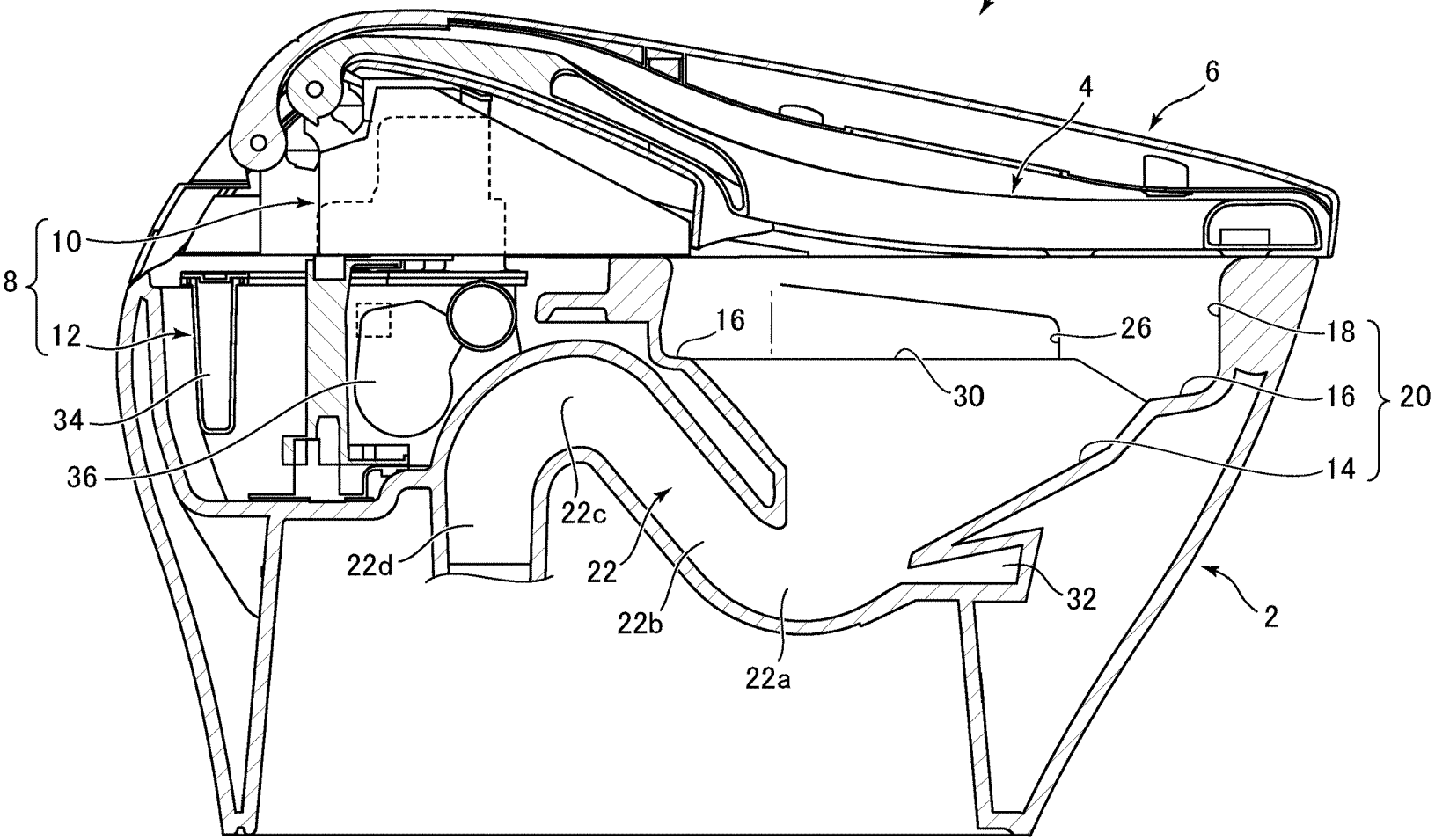
FIG. 2 is a cross section seen from the left side of the center cross section in the left-right direction of a flush toilet according to the first embodiment of the invention, in a state whereby the toilet lid and toilet seat are rotated up to a down position.

First, FIG. 1 is a perspective view showing a flush toilet according to the first embodiment of the invention, in a state whereby the toilet lid and toilet seat are rotated up to an up position. Also, FIG. 2 is a cross section seen from the left side of the center cross section in the left-right direction of a flush toilet according to the first embodiment of the invention, in a state whereby the toilet lid and toilet seat are rotated up to a down position. In addition, FIG. 3 is a partial plan view showing the toilet main body part of a flush toilet according to the first embodiment of the invention shown in FIG. 1.

Figure 3:
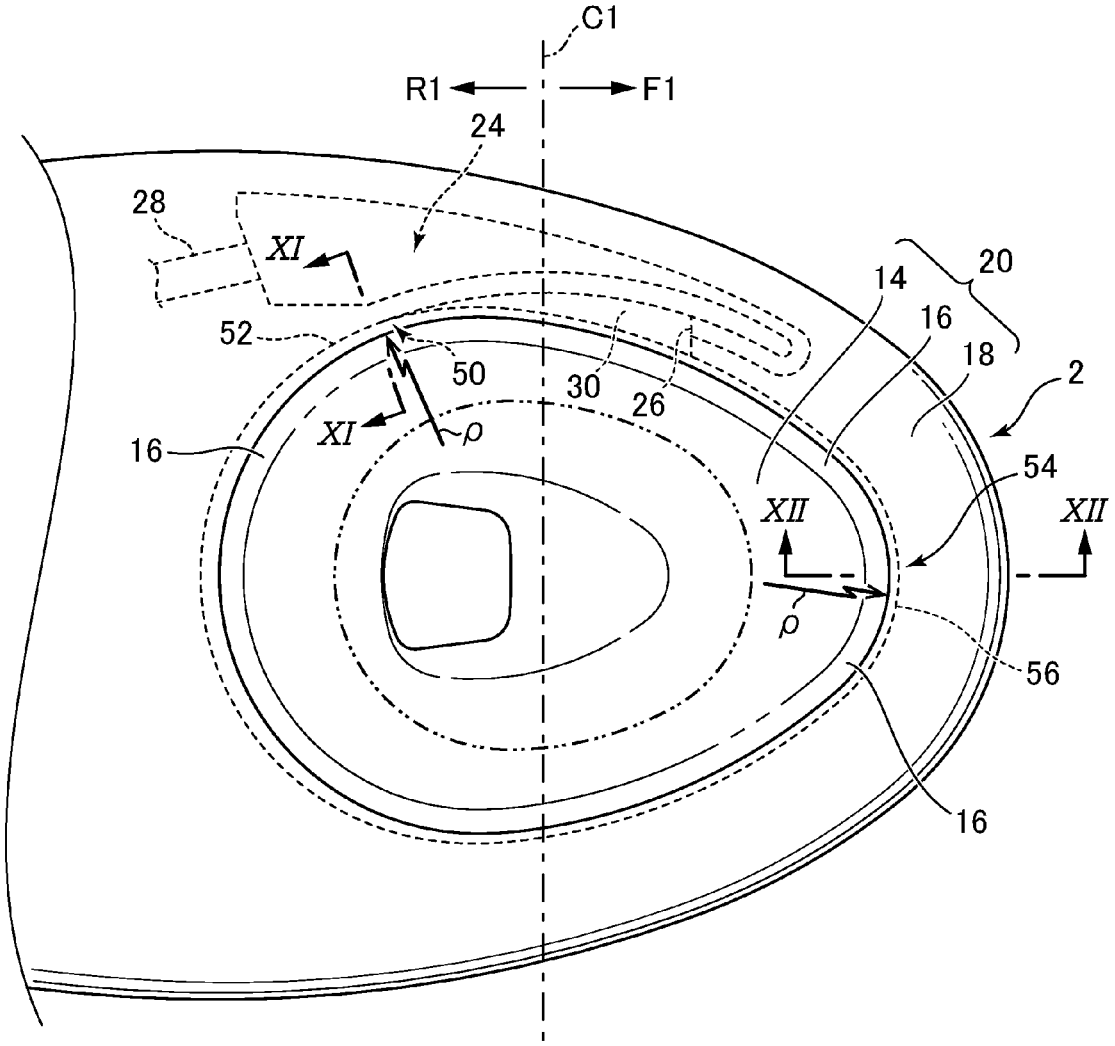
FIG. 3 is a partial plan view showing the toilet main body part of a flush toilet according to the first embodiment of the invention shown in FIG. 1.

As shown in FIGS. 1 through 3, the flush toilet 1 according to the first embodiment of the invention comprises: a ceramic toilet main body 2; a toilet seat 4 on the top surface of this toilet main body 2, disposed to be rotatable in the up or down direction; a toilet lid 6 disposed to be rotatable in the up or down direction so as to cover the this toilet seat 4; and a functional portion 8 disposed on the rear of the toilet main body 2.

Also, as shown in FIG. 2, the functional portion 8 comprises a sanitary wash system functional portion 10, disposed on the rear upper portion of the toilet main body 2 and functioning as a sanitary wash portion for washing a user's private part; and a water supply system functional portion 12 pertaining to the function of supplying water to the toilet main body 2.

Next, as shown in FIGS. 1 through 3, the toilet main body 2 comprises a bowl 20 comprising a bowl-shaped waste receiving surface 14 and a rim 18, formed to rise up from the shelf surface 16 on the top edge of the waste receiving surface 14.

Also, as shown in FIG. 2, the toilet main body 2 comprises a discharge trap pipe 22, being a discharge path for discharging waste in the bowl 20, wherein an inlet 22*a* is connected at the bottom of the bowl 20.

Next, as shown in FIG. 3, the bowl 20 comprises a front area F1 in front of, and a rear area R1 to the rear of a center line C1, which extends in the left-right direction, dividing the bowl into two equal parts in the front-rear direction; a rim water passageway 24 (described in detail below), which is part of the rim spouting portion, is formed on the rim 18 on either the left or right side inside the front area F1 of this bowl 20, i.e., on the interior of the right-side rim 18 in the front area F1 of the bowl 20 as seen from the front of the toilet main body 2.

Also, a flush water tank 26 (details below), which is a portion of the rim spouting portion, is formed on the downstream end of this rim water passageway 24.

In addition, as shown in FIG. 3, the upstream side of the rim passage 24 is connected to the water supply pipe 28, which is the conduit supplying the rim passage 24 with flush water supplied from a utility water source (not shown). The upstream side of this water supply pipe 28 is directly connected to the water utility serving as wash water supply; using the supply pressure of this water utility supply, wash water supplied from the water supply pipe 28 into the rim water passageway 24 is guided forward within the rim water passageway 24, after which it bends toward the inside and toward the rear, and is guided to the downstream side rim spout port 26.

Flush water guided to the rim spout port 26 is spouted (rim spouted) toward the rear, and forms a circulating flow inside the bowl 20 by passing through the water passageway formed close to the downstream side of the rim spout port 26 (details below) to circulate inside the bowl 20.

Note that the spout port disposed on the rim 18, which spouts flush water to form a circulating flow inside the bowl 20, is the rim spout port 26 only.

Note that in the flush toilet 1 of the present embodiment, it is explained that the rim water passageway 24 and the rim spout port 26 serving as the rim spouting portion pertain to the form in which these elements are disposed inside the right side rim 18 within the front area F1 of the bowl 20 as seen from the front of the toilet main body 2. However, without such limitation, the rim spouting may also be performed toward the rear by disposing the rim spouting port on the left side rim 18 within the front area F1 of the bowl 20 as seen from the front of the toilet main body 2.

In other words, for the rim water passageway and rim spouting port serving as rim spout portion, any form disposed on either the left or right side within the front area F1 of the bowl 20 and spouting toward the rear is acceptable.

In the flush toilet 1 of the present embodiment, the rim water passageway 24 and rim spout port 26 which serve as the rim spouting portion are formed as an integral unit with the toilet main body 2 by forming ceramic material, but for example a constitution in which this portion is formed separately from the toilet main body 2 of resin or the like and attached to the toilet main body 2 would also be acceptable.

In addition, as shown in FIG. 2, a jet spout port 32 is disposed on the bottom portion of the bowl 20 so as to be directed toward the inlet 22*a* of the discharge trap pipe 22. Spouting (jetting) by this jet spout port 32 is accomplished by flush water stored in a reservoir tank 34 mounted on the water supply system functional portion 12, pressurized by a pressurizing pump 36 in the water supply system functional portion 12 to be discharged from the jet spout port 32.

Also, flush water discharged from the jet spout port 32, after flowing from the inlet 22*a* of the discharge trap pipe 22 into an ascending pipe 22*b* to the rear of this inlet 22*a*, flows within this ascending pipe 22*b*, from the peak portion 22*c* of the discharge trap pipe 22 out to the descending pipe 22*d*.

Because the specific structures of the sanitary flush system functional portion 10 and water supply system functional portion 12 are respectively the same as in conventional examples, here, a detailed explanation thereof is omitted, but a private part washing device (not shown) including a nozzle device (not shown) for jetting flush water toward a user above the bowl 20 is provided on the sanitary flush system functional portion 10.

In addition, items such as a reservoir portion (not shown) for storing flush water supplied to a private part washing device (not shown), a heater (not shown) for warming flush water in this reservoir portion (not shown) to an appropriate temperature, a ventilation fan (not shown), an odor removal fan (not shown), a warm air fan (not shown), and a controller (not shown) for controlling the operation of these devices are disposed in the sanitary flush system functional portion 10.

At the same time, the water supply path (not shown) on the water supply system functional portion 12 is connected on its upstream side to a water utility (not shown) serving as water supply, and items such as a fixed flow valve (not shown), an electromagnetic valve (not shown), and a switching valve (not shown) for switching between supplying water to the reservoir tank (not shown) and spouting to the rim spout port 26 are disposed on the upstream side supply path to the reservoir tank (not shown). In addition to the above, a controller (not shown) or the like for controlling the opening and closing operation of the electromagnetic valve (not shown), the switching operation of the switching valve (not shown), and the rpm and operating time, etc. of the pressurizing pump (not shown) are also provided on the water supply system functional portion 12.

Note that in the flush toilet 1 according to the present embodiment, what is known as a "hybrid" type of flush toilet is explained, in which utility water pressure is utilized for rim spouting by the rim spout port 26, so that for jet spouting by the jet spout port 32, flush water is supplied into the reservoir tank (not shown) by controlling a pressurizing pump (not shown). However, the invention is not limited to this form, and may also be applied to other forms. I.e., other acceptable forms include one in which, for flush water directly supplied from a utility water supply only, rim spouting by the rim spout port 26 and jet spouting by the jet spout port 32 are switched by switching a valve, and a form in which, for flush water in a reservoir tank, rim spouting by the rim spout port 26 and jet spouting by the jet spout port 32 are switched by switching pumps alone.

Next, referring to FIGS. 1 through 7, details of the rim water passageway 24 and rim spout port 26 in a flush toilet 1 according to the first embodiment of the invention are explained.

Figure 4:
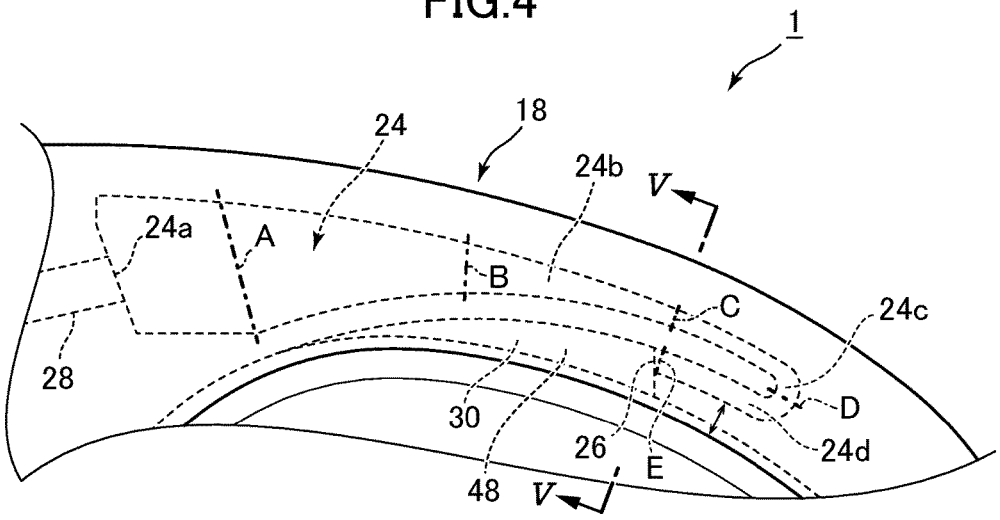
FIG. 4 is a partial expanded plan view of a rim water passageway, showing an expansion of part of the rim water passageway formed inside the rim, in the toilet main unit part of a flush toilet according to the first embodiment of the invention shown in FIG. 3.
Figure 5:
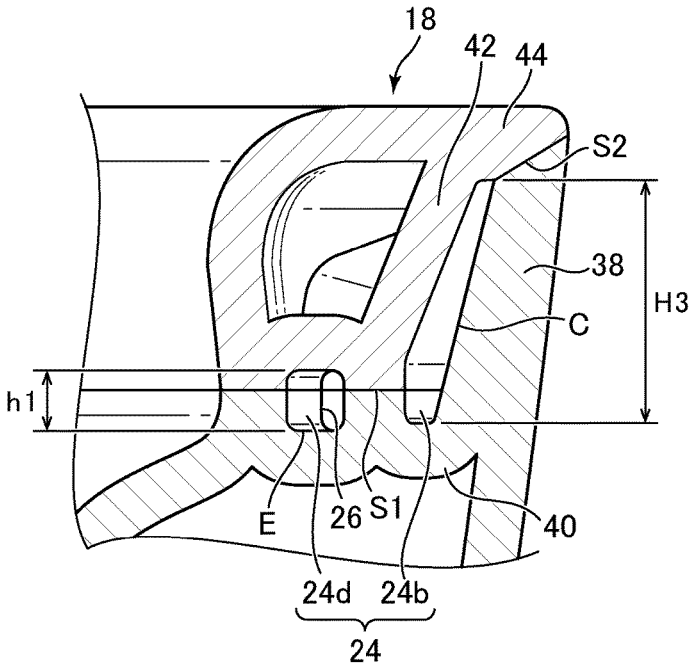
FIG. 5 is a partial expanded cross section of the rim along line V-V in FIG. 4.

FIG. 4 is a partial expanded plan view of a rim water passageway, expanding part of the rim water passageway formed inside the rim, in the toilet main unit part of a flush toilet according to the first embodiment of the invention shown in FIG. 3, and FIG. 5 is a partial expanded cross section of the rim along line V-V in FIG. 4.

Figure 6A:
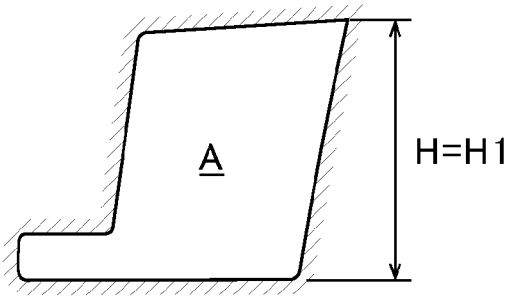
FIG. 6A is the cross section A of the rim water passageway shown in FIG. 4.
Figure 6B:
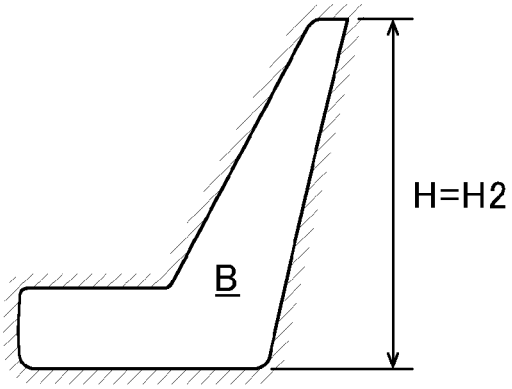
FIG. 6B is the cross section B of the rim water passageway shown in FIG. 4.
Figure 6C:
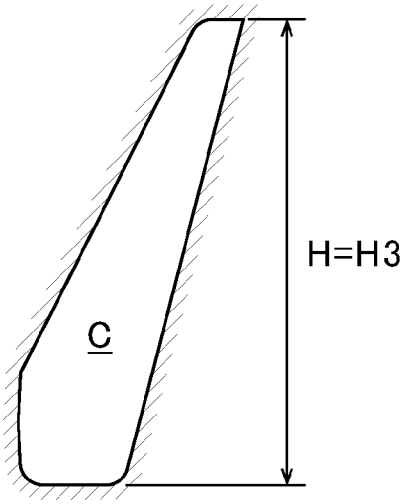
FIG. 6C is the cross section C of the rim water passageway shown in FIG. 4.
Figure 6D:
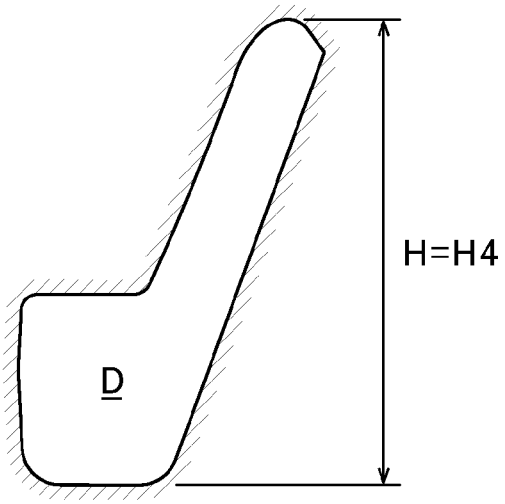
FIG. 6D is the cross section D of the rim water passageway shown in FIG. 4.
Figure 6E:
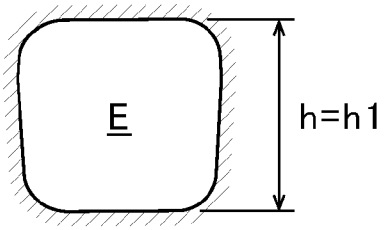
FIG. 6E is the cross section E of the rim water passageway shown in FIG. 4.

FIG. 6A is the cross section A of the rim water passageway shown in FIG. 4, and FIG. 6B is the cross section B of the rim water passageway shown in FIG. 4. Furthermore, FIG. 6C is the cross section C of the rim water passageway shown in FIG. 4, and FIG. 6D is the cross section D of the rim water passageway shown in FIG. 4. FIG. 6E is the cross section E of the rim water passageway shown in FIG. 4.

First, as shown in FIG. 4, the rim water passageway 24 comprises an outside passageway 24*b* extending from the inlet 24*a* connected to the water supply pipe 28 through the interior of the rim 18 toward the front, a bent passageway 24*c*, which bends to the inside from the downstream end of this outside passageway 24*b*, and an inside passageway 24*d*, extending from this bent passageway 24*c* rearward up to the rim spout port 26.

Also, as shown in FIGS. 5 and 6A through 6E, if H is the maximum height of the cross section of the outside passageway 24*b* and the bent passageway 24*c* of the rim water passageway 24 and h is the maximum height of the cross section of the rim water passageway 24 inside passageway 24*d*, the maximum height dimension h1 of each cross section E of the inside passageway 24*d* of the rim water passageway 24 is set to be smaller than each of the maximum height dimensions H1 through H3 of the cross sections A through C of the outside passageway 24*b* of the rim water passageway 24 and the maximum height dimension H4 of the bent passageway 24*c* of the rim water passageway 24.

Note than in the flush toilet 1 of the present embodiment, for example, a setting of 1:2 to 1:8 is preferable and a setting of 1:2 to 1:5 is most preferable as the ratio (h1:H4) of the maximum height dimension h1 of the cross section E of the inside passageway 24*d* to the maximum height dimension H4 of the cross section D at the downstream end of the outside passageway 24*b* (the upstream end of the bent passageway 24*c*) of the rim water passageway 24.

Thus compared to a flush toilet different from the present invention, for example, wherein to reduce the friction resistance etc. of the rim water passageway internal wall surface, the cross section of the rim water passageway is formed by a cross section having essentially the same circular cross section, or a cross section with essentially the same vertical to horizontal ratio, over the entire range from the upstream end to the downstream end of the rim water passageway, the flush toilet 1 of the present embodiment enables the total width etc. of the rim 18 required by the rim water passageway 24 and the rim spout port 26 serving as rim spout portion to be effectively set to a smaller size.

Therefore air space other than for flush water inside the rim water passageway 24 can be reduced when water is passing through, and rim spouting by the rim spout port 26 can be efficiently performed.

Also, odd sounds caused by the drawing in of air to the rim water passageway 24 when water passes through can be made less likely to occur.

In addition, because reducing the total volumetric space inside the rim water passageway 24 enables more room to be provided for the space around the rim water passageway 24, which is made to bend from the outside passageway 24*b* of the rim water passageway 24 through the bent passageway 24*c* to the inside passageway 24*d*, flush water pressure losses inside the rim water passageway 24 can be suppressed, and freedom of toilet design relative to the bowl 20 rim 18 shape, etc. can be assured.

Next, as shown in FIG. 5, the outside passageway 24*b* of the rim water passageway 24 comprises: an outside wall 38 on the outer perimeter of the rim 18; a lower side wall 40 formed as an integral piece on the inside, from the bottom edge of the this outside wall 38; an inside wall 42, opposing the outside wall 38 in the horizontal direction and adhered at its bottom edge to the top edge of the lower side wall 40; and an upper side wall 44, formed as an integral piece with the top edge of this inside wall 42, and adhered to the top edge of the outside wall 38.

The adhesion surface S1 between the top edge surface of the rim water passageway 24 outside passageway 24*b* lower side wall 40 and the inside wall 42 bottom edge surface is formed to be essentially a horizontal surface, and the adhesion surface S2 between the outside wall 38 top edge surface and the upper side wall 44 is formed to be a sloped surface, sloping relative to the essentially horizontal surface.

Note that "essentially horizontal surface" here means not only completely horizontal surfaces, but also generally horizontal surfaces on which the lower side wall 40 top edge surface (adhesion surface) and the inside wall 42 bottom edge surface (adhesion surface) can be mutually separated in the horizontal direction.

Thus during manufacturing of the flush toilet 1 of the present embodiment, for example, when the upper side wall 44 adhesion surface S2 is being adhered to the rim water passageway 24 outside wall 38 adhesion surface S2 at the same time as the inside wall 42 bottom edge adhesion surface S1 is being adhered to the rim water passageway 24 lower side wall 40 top edge adhesion surface S1, the adhesion surface S1 on the outside wall 38 and the adhesion surface S1 on the upper side wall 441, which form mutually sloping surfaces relative to the horizontal surface, can make secure contact first, even if the adhesion surface S1 of the lower side wall 40 forming the horizontal surface and the adhesion surface S1 of the inside wall 42 become mutually separated in the horizontal direction due to manufacturing tolerances, etc.

Therefore the cross sections A-E from the outside passageway 24*b* to the inside passageway 24*d* in the rim water passageway 24 can be prevented from being completely collapsed by the mutual separation between the lower side wall 40 adhesion surface S1 and the inside wall 42 adhesion surface S1, so a water passing area of the rim water passageway 24 can be secured over the whole area.

Next, referring to FIG. 4 and to FIGS. 7 through 10C, the water passageway 30 formed close to the downstream side of the rim spout port 26 in a flush toilet 1 according to the first embodiment of the invention is explained in detail.

Figure 7:
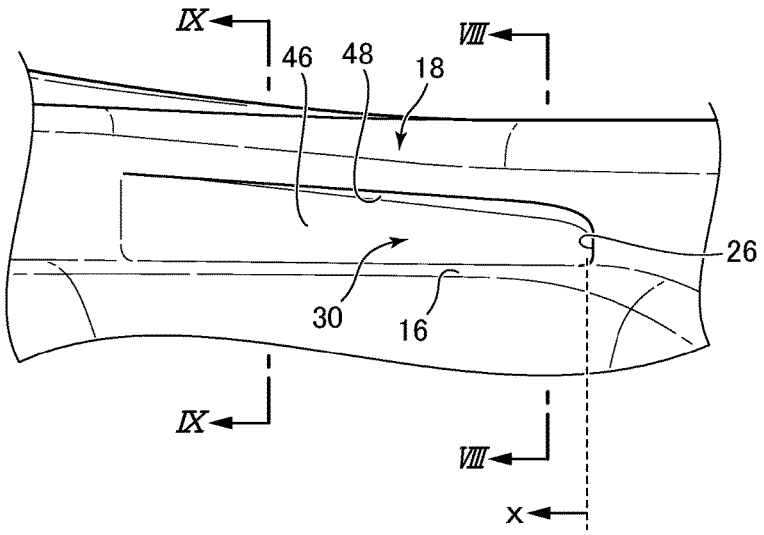
FIG. 7 is a partial expanded side view showing an expansion of the part of the water passageway close to the downstream side of the rim spouting port, in a flush toilet according to the first embodiment of the invention shown in FIG. 2.
Figure 8:
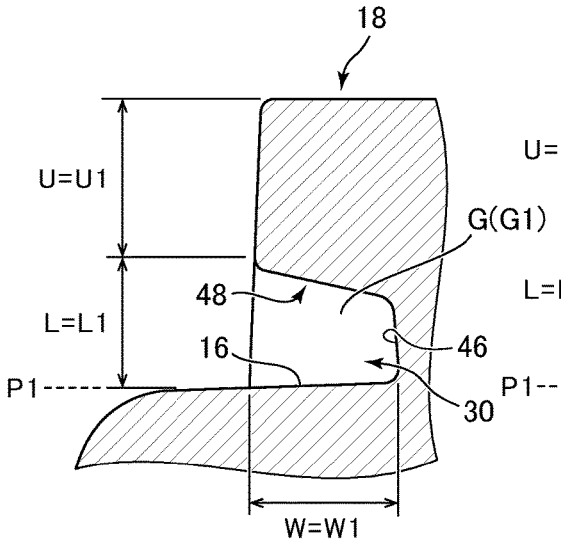
FIG. 8 is a cross section along line VIII-VIII in FIG. 7.

FIG. 7 is a partial expanded side view showing an expansion of the part of the water passageway close to the downstream side of the rim spouting port, in a flush toilet according to the first embodiment of the invention shown in FIG. 2; FIG. 8 is a cross section along line VIII-VIII in FIG. 7; and FIG. 9 is a cross section along line IX-IX in FIG. 7.

Figure 10A:
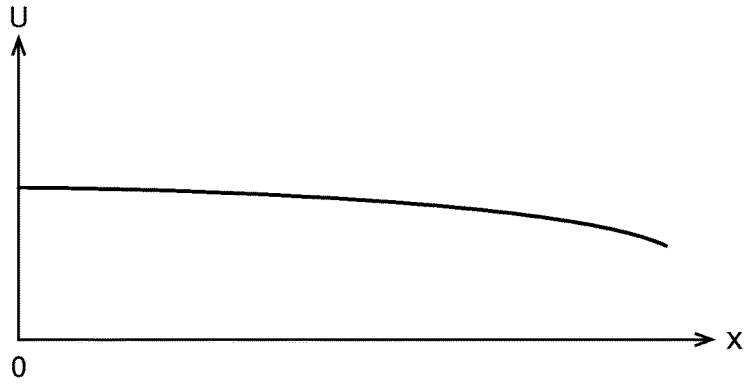
FIG. 10A qualitatively depicts the relationship between the distance (x) in the circumferential direction downstream side from the rim spouting port in the water passageway close to the downstream side of the rim spouting port, and the height dimension (U) of the overhang portion, in a flush toilet according to the first embodiment of the invention.
Figure 10B:
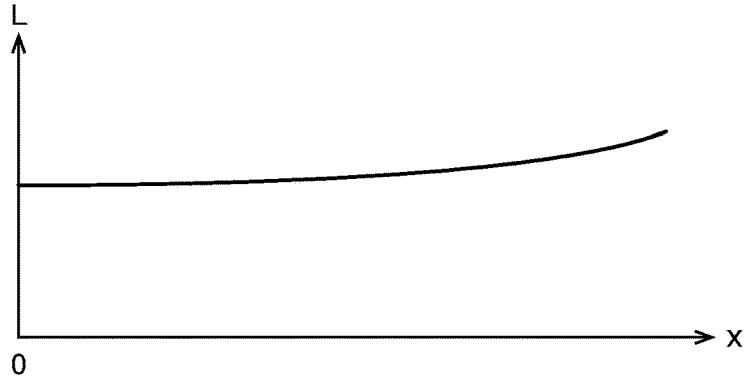
FIG. 10B qualitatively depicts the relationship between the distance (x) on the circumferential downstream side from the rim spouting port in the water passageway close to the downstream side of the rim spouting port, and the maximum height dimension (L) from the shelf surface to the bottom edge of the overhang portion, in a flush toilet according to the first embodiment of the invention.
Figure 10C:
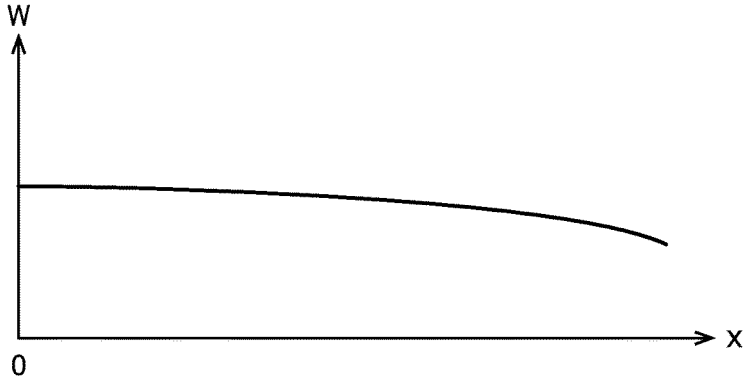
FIG. 10C qualitatively depicts the relationship between the distance (x) on the circumferential downstream side from the rim spouting port in the water passageway close to the downstream side of the rim spouting port, and the width (W) of the water passageway on the downstream side of the rim spouting port, in a flush toilet according to the first embodiment of the invention.

FIG. 10A qualitatively depicts the relationship between the distance (x) on the circumferential downstream side from the rim spouting port in the water passageway close to the downstream side of the rim spouting port, and the height dimension (U) of the overhang portion, in a flush toilet according to a first embodiment of the invention; FIG. 10B qualitatively depicts the relationship between the distance (x) on the circumferential downstream side from the rim spouting port in the water passageway close to the downstream side of the rim spouting port, and the maximum height dimension (L) from the shelf surface to the bottom edge of the overhang portion, in a flush toilet according to a first embodiment of the invention; and FIG. 10C qualitatively depicts the relationship between the distance (x) on the circumferential downstream side from the rim spouting port in the water passageway close to the downstream side of the rim spouting port, and the width (W) of the water passageway on the downstream side of the rim spouting port, in a flush toilet according to the first embodiment of the invention.

Figure 9:
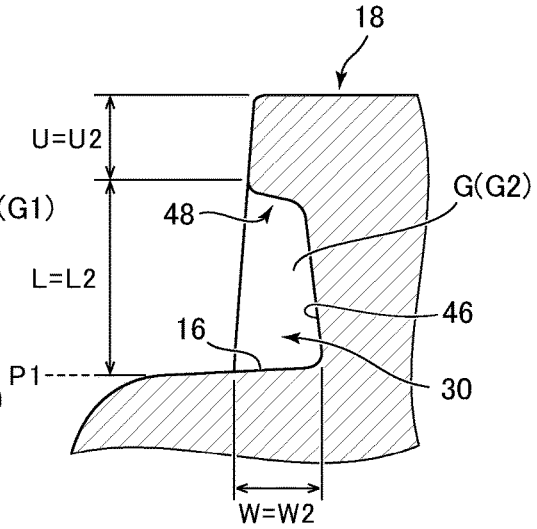
FIG. 9 is a cross section along line IX-IX in FIG. 7.

First, as shown in FIGS. 7 through 9, the curved portion 50 of the bowl 20 from the downstream end of the rim spout port 26 (details below), i.e., the water passageway 30 formed close to the downstream side of the rim spout port 26, forms a cross section G using the inner circumference surface 46 of the rim 18, the shelf surface 16 formed on the bottom side of the inner circumference surface 46 of this rim 18, and the overhang portion 48 formed on the top side of the inner circumference surface 46.

Of the entire circumference of the rim 18, the overhang shape is formed only in the water passageway 30, and the inner circumferential surface of the rim 18 other than the water passageway 30 is formed to extend in a straight line up and down in a vertically cut cross section, and does not comprise an overhang shape like the overhang portion 48.

As shown in FIG. 4 and FIGS. 7 through 10C, the water passageway 30 is set so that the maximum height dimension L of the cross section G increases toward the downstream, and the width W thereof is set to decrease toward the downstream, so the cross sectional area A0 of the cross section G is approximately constant from the rim spout port 26 toward the downstream side.

I.e., the minimum thickness U2 in the vertical direction of the overhang portion 48 of water passageway 30 shown in FIG. 9, for example, is set to be smaller than the minimum thickness U1 in the vertical direction of the water passageway 30 shown in FIG. 8, so the cross sectional area A0 of the cross section G is approximately constant.

Also, the maximum height dimension L2 in the vertical direction of the water passageway 30 in the cross section G2 shown in FIG. 9 is larger than the maximum height dimension L1 of the cross section G2 of the water passageway 30 shown in FIG. 8, so the cross sectional area A0 of the cross section G is approximately constant.

Here the phrase "the cross sectional area A0 is approximately constant" includes not only the meaning of being completely constant, but also the meaning of "approximately constant," whereby rim spout water passing through the cross section G of the water passageway 30 on the downstream side of the rim spout port 26 after being spouted from the rim spout port 26 is able to flow to the downstream side along the interior of the water passageway 30, with turbulence suppressed, so that it effectively forms a stable circulating flow within the downstream side bowl 20.

The width W2 of the water passageway 30 in the cross section G2 shown in FIG. 9 is smaller than the width W1 of the water passageway 30 in the cross section G1 of the water passageway 30 shown in FIG. 8, therefore the cross sectional area A0 of the cross section G is constant.

In addition, as shown in FIGS. 8 and 9, the shelf surface 16 forming the cross section G of the water passageway 30 is formed so that the height position P1 thereof is positioned at approximately a constant height from the rim spout port 26 toward the downstream side.

Here the phrase "approximately constant height position" includes not only the meaning of completely constant, but also the meaning of "approximately constant," whereby rim spout water passing through the cross section G of the water passageway 30 on the downstream side of the rim spout port 26 after being spouted from the rim spout port 26 is able to flow to the downstream side along the interior of the water passageway 30, with turbulence suppressed, so that it effectively forms a stable circulating flow within the downstream side bowl 20.

Rim spout water passing through the cross section G of the water passageway 30 after being spouted from the rim spout port 26 is thus kept from becoming turbulent, and is able to flow to the downstream side along the inside of the water passageway 30, so that a stable circulating flow can be effectively formed inside the bowl 20 on the downstream side.

In addition, flush water spouted from the rim spout port 26, by forming a stable downstream side flow matching the water passageway 30 on the downstream side thereof, can prevent splashing of flush water, effectively raising the visibility and cleanability of the bowl 20.

Note that, as shown in FIGS. 8 and 9, the ratio (U:L) of the minimum thickness U in the vertical direction of the overhang portion 48, which is the minimum height dimension of the overhang portion 48 in the cross section G of the water passageway 30, to the maximum height dimension L in the vertical direction of the water passageway 30, which is the maximum height dimension from the shelf surface 16 to the bottom edge of the overhang portion 48, is preferably set from 1:6 to 6:1, and is more preferably set from 1:3 to 3:1.

Also, as shown in FIG. 3, the inner circumferential wall of the rim 18 formed on the right rear side of the bowl 20, and on the downstream side of the water passageway 30, forms a curved portion 50 which changes from a small to a large curvature (1/ρ) in proportion to distance (x) from the rim spout port 26 toward the circumferential downstream side (i.e., its curvature radius ρ changes from large to small). In other words, this curved portion 50 is formed by a clothoid curve or other transition curve 52 in which, as seen in plan view in FIG. 3, the curvature (1/ρ) changes at a constant proportion from small to large (i.e., the curvature radius ρ changes from large to small at a constant proportion).

Similarly, as shown in FIG. 3, the inner circumferential wall of the rim 18 in the region at the front side inside the bowl 20 also forms a curved portion 54 in which the curvature (1/ρ) changes from small to large from the left rear side of the rim 18 toward the front according to the distance (x) from the rim spout port 26 toward the circumferential direction downstream side (i.e., the curvature radius ρ changes from large to small). This curved portion 54 is formed by a clothoid curve or other transition curve 56 in which, as seen in the plan view shown in FIG. 3, the curvature (1/ρ) changes at a constant rate from small to large (i.e., the curvature radius ρ changes from large to small at a constant proportion).

As a result, when flush water spouted from the rim spout port 26 first circulates along the curved portion 50, sudden changes in centrifugal force relative to the flush water can be effectively suppressed so that the flush efficiency inside the bowl 20 can be improved.

In addition, flush water circulating along the curved portion 50, after passing through the rear area inside the bowl 20 along the inner circumferential wall of the rim 18 and circulating to the downstream side in the circumferential direction, then circulates the front area inside the bowl 20 along the curved portion 54, but the occurrence of sudden changes in centrifugal force relative to flush water when circulating over this curved portion 54 can be suppressed, so that flushing efficiency inside the bowl 20 can be improved.

In the flush toilet 1 of the present embodiment, for the respective transition curves 52, 56 of each of the curved portions 50, 54 formed by the inner circumferential wall of the rim 18, it is explained that an example where a clothoid curve, in which the curvature ratio changes at a constant rate, was adopted; however a non-clothoid transition curve such as a sine half-wavelength diminishing curve or the like may also be used as the transition curve.

Next, referring to FIG. 3 and FIGS. 11 through 13B, details of the curved portions 50, 54 formed by the transition curves 52, 56 as seen in plan view in the bowl 20 of a flush toilet 1 according to the first embodiment of the invention are explained.

Figure 11:
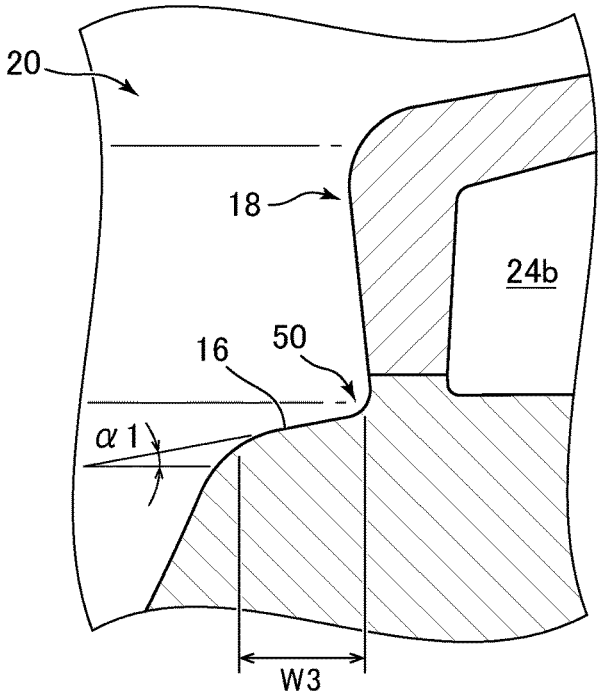
FIG. 11 is a cross section along line XI-XI in FIG. 3.
Figure 12:
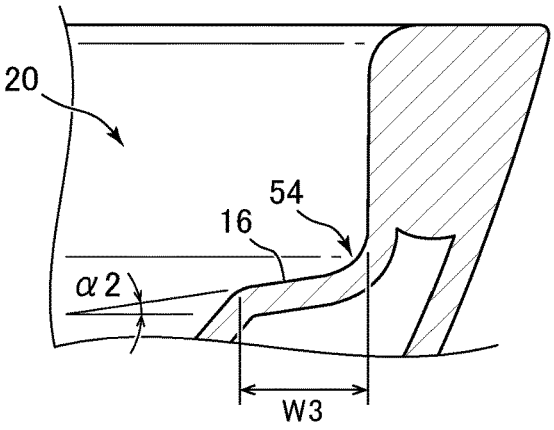
FIG. 12 is a cross section along line XII-XII in FIG. 3.

Here, FIG. 11 is a cross section along line XI-XI in FIG. 3, and FIG. 12 is a cross section along line XII-XII in FIG. 3.

Figure 13A:
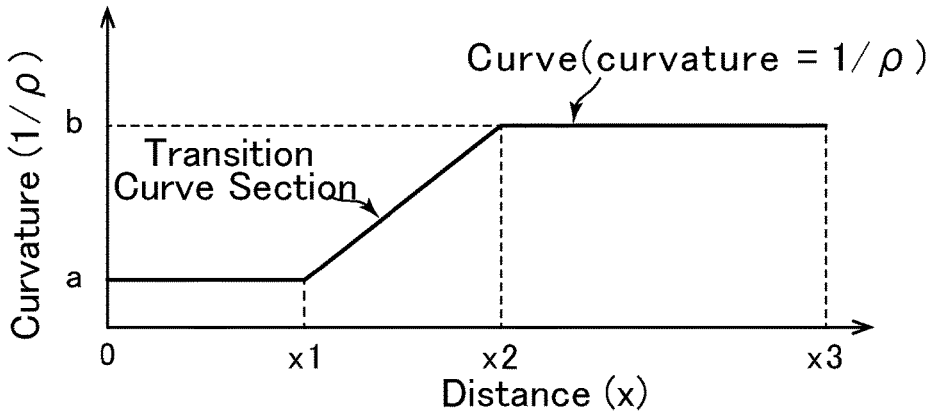
FIG. 13A qualitatively depicts changes in the distance (x) and the curvature (1/ρ) on the circumferential downstream side from the rim spouting port, when the bowl portion and the bent passageway are connected by a transition curve in a flush toilet according to the first embodiment of the invention.
Figure 13B:
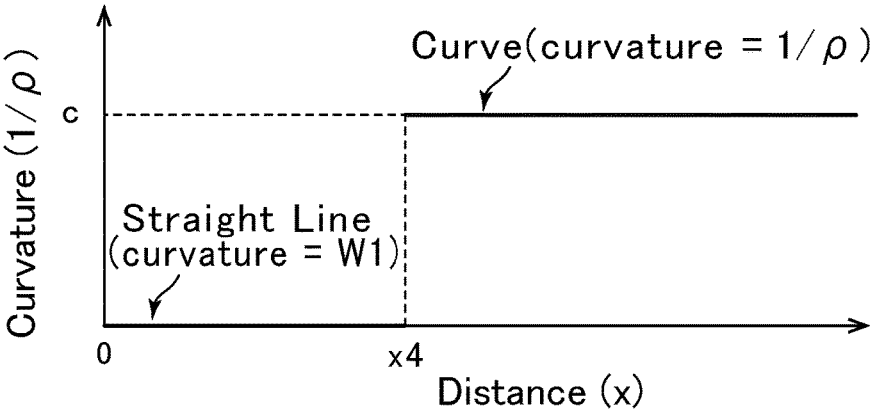
FIG. 13B is a comparative example pertaining to a flush toilet according to the first embodiment of the invention shown in FIG. 13A, qualitatively depicting changes in the distance (x) and the curvature (1/ρ) on the circumferential direction downstream side from the rim spouting port, when the straight line portion and the bent passageway of the bowl are connected by a curve tangential to a straight line.

Also, FIG. 13A qualitatively depicts changes in the distance (x) and the curvature (1/ρ) on the circumferential downstream side from the rim spouting port, when the bowl portion and the bent passageway are connected by a transition curve in a flush toilet according to the first embodiment of the invention; FIG. 13B is a comparative example relative to a flush toilet according to the first embodiment of the invention shown in FIG. 13A, qualitatively depicting changes in the distance (x) and the curvature (1/ρ) on the circumferential downstream side from the rim spouting port, when the straight line portion and the bent passageway of the bowl are connected by a curve tangential to a straight line.

First, as shown in FIG. 3 and FIGS. 11 and 12, the bowl 20 forms a shelf surface 16 on the curved portions 50, 54 formed by each of the transition curves 52, 56; the width W3 of this shelf surface 16 is approximately constant along the circumferential direction of the bowl 20.

Note that "approximately constant" includes not only perfectly constant, but also approximately constant, whereby when flush water spouted from the rim spout port 26 on the rim water passageway 24 circulates on the shelf surface 16 of the curved portions 50, 54, the occurrence of sudden changes in centrifugal force relative to flush water can be more effectively suppressed.

Also, as shown in FIGS. 11 and 12, the respective shelf surfaces 16 on the curved portions 50, 54 formed by each of the bowl 20 transition curves is formed to a respective slope angle α1, α2 relative to a horizontal plane.

Here it is preferable for the size of the slope angle α1 to be set between 0° and 15°, and more preferably between 2° and 8°.

The slope angle α2 is set larger than the slope angle α1, and is preferably set to between 3° and 60°, and more preferably between 5° and 30°.

As a result of the above, when flush water spouted from the rim spout port 26 circulates along the shelf surface 16 of the curved portions 50, 54, sudden changes in centrifugal force relative to the flush water can be more effectively suppressed, so flushing inside the bowl 20 can be better improved.

As shown in FIG. 13A, in the flush toilet 1 of the present embodiment, in cases where the essentially straight line-shaped straight portion and the curved portion of the bowl 20 are connected by a transition curve, the curvature 1/ρ will be a (e.g. ρ1=800 mm; a=1/ρ1=0.00125 (l/mm)) in the section between a distance x of 0 and the distance x1 (e.g. x1=50 mm) on the conduit downstream side from the rim spout port 26; this section forms a straight portion with an essentially straight line shape.

Next, as shown in FIG. 13A, the section from a distance x of x1 to x2 (e.g., x2=200 mm) is a section (the transition curve section) which forms a curved portion by a transition curve in which the curvature 1/ρ changes at a constant rate from a through b (e.g., ρ1=800 mm, a=1/ρ1=0.00125, ρ2=150 mm; b=1/ρ2=0.00667 (l/min)).

As shown in FIG. 13A, in the section from distance x2 to x3 (e.g., x3=380 mm), the curvature 1/ρ2 has a constant b (for example, ρ2=150 mm; b=1/ρ2=0.00667 (l/mm)), such that the section forms a curved portion with an approximately constant curvature.

On the other hand, as shown in FIG. 13B, in the comparative example for the case in which the straight line portion and the curved portion of the bowl are connected by a curve tangential to a straight line, the occurrence of sudden changes in centrifugal force relative to flush water when flush water spouted from the rim spout port circulates along the shelf surface of the bent passageway is greater than in the flush toilet 1 of the present embodiment, due to the sudden change in curvature 1/ρ from 0 (curvature radius 1/ρ=∞) to c (curvature radius 1/ρ=ρ3) around the point where the distance x is x4, so flushing efficiency in the bowl is reduced.

Next the operation of a flush toilet 1 according to the above-described first embodiment of the invention is explained.

First, in a flush toilet 1 according to the first embodiment of the invention, the water passageway 30 formed close to the downstream side of the rim spout port 26 forms a flow path cross section G with the rim 18 inner circumferential surface 46, the shelf surface 16 formed on the lower side of the inner circumferential surface 46 of this rim 18, and the overhang portion 48 formed on the top side of the inner circumferential surface 46 of the rim 18; the maximum height dimension L of this flow path cross section G is set to increase with distance from the rim spout port 26 toward the downstream side, and the flow path cross section G width W is set to decrease with distance on the downstream side, so that for the water passageway 30, the cross sectional area A0 of the flow path cross section G is approximately constant from the rim spout port 26 toward the downstream side; by so doing, rim spout water passing through the flow path cross section G of the water passageway 30 on the downstream side of the rim spout port 26 after being spouted from the rim spout port 26 is able to flow on the downstream side along the inside of the water passageway 30 with turbulence suppressed, so that a stable circulating flow can be effectively formed on the inside of the bowl 20 on the downstream side.

With flush water spouted from the rim spouting port 26, a stable flow can be formed on the downstream side matching the water passageway 30 on the downstream side thereof, thereby preventing flush water from splashing, so that bowl 20 visibility and cleanability can be effectively improved.

Next, in a flush toilet 1 according to the present embodiment, the height position P1 of the shelf surface 16 forming the flow path cross section G of the water passageway 30 formed on the downstream side of the rim spout port 26 is formed at an approximately constant height position, from the rim spout port 26 toward the downstream side; by so doing, rim spout water passing through the flow path cross section G of the water passageway 30 on the downstream side of the rim spout port 26 after being spouted from the rim spout port 26 is able to flow on the downstream side along the inside of the water passageway 30 with turbulence suppressed, and to even more effectively form a stable circulating flow on the downstream side.

With flush water spouted from the rim spouting port 26, a stable flow can be formed on the downstream side matching the water passageway 30 on the downstream side thereof, thereby preventing flush water from splashing, so that bowl 20 visibility and cleanability can be more effectively improved.

Using a flush toilet 1 according to the present embodiment, the ratio (U:L) of the minimum height dimension U of the overhang portion in the flow path cross section G of the water passageway 30 formed on the downstream side of the rim spout port 26 to the maximum height dimension L from the shelf surface 16 to the bottom edge of the overhang portion 48 is set between 1:2 and 1:8; by so doing, rim spout water passing through the flow path cross section G of the water passageway 30 on the downstream side of the rim spout port 26 after being spouted from the rim spout port 26 is able to flow on the downstream side along the inside of the water passageway 30 with turbulence suppressed, and to even more effectively form a stable circulating flow on the downstream side.

With flush water spouted from the rim spouting port 26, a stable flow can be formed on the downstream side matching the water passageway 30 on the downstream side thereof, thereby preventing flush water from splashing, so that bowl 20 visibility and cleanability can be even more effectively improved.

Next, referring to FIGS. 14 through 16C, a flush toilet according to a second embodiment of the invention is explained.

Figure 14:
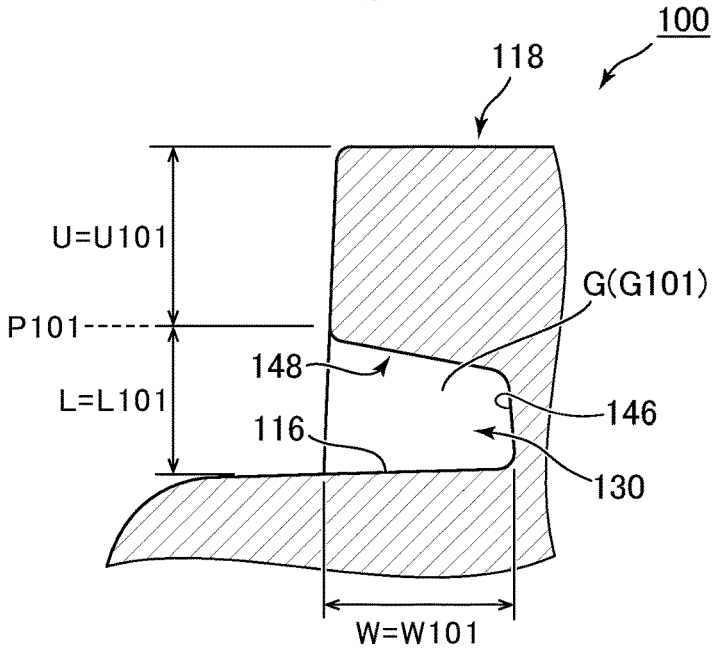
FIG. 14 is a cross section similar to FIG. 8, in a water passageway on the downstream side of the rim spouting port in a flush toilet according to a second embodiment of the invention.
Figure 15:
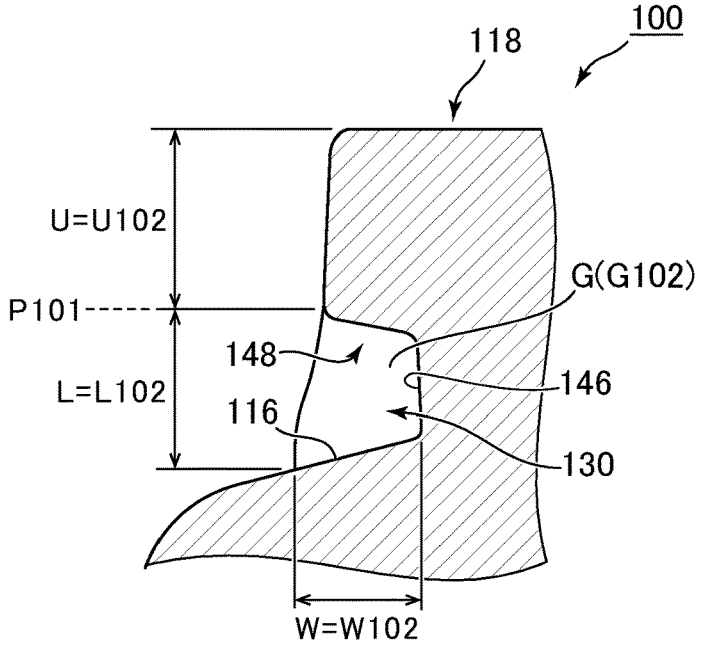
FIG. 15 is a cross section similar to FIG. 9, in a water passageway on the downstream side of the rim spouting port in a flush toilet according to a second embodiment of the invention.

FIG. 14 is cross section similar to FIG. 8, in a water passageway on the downstream side of the rim spouting port in a flush toilet according to a second embodiment of the invention; FIG. 15 is a cross section similar to FIG. 9, in a water passageway on the downstream side of the rim spouting port in a flush toilet according to a second embodiment of the invention.

Figure 16A:
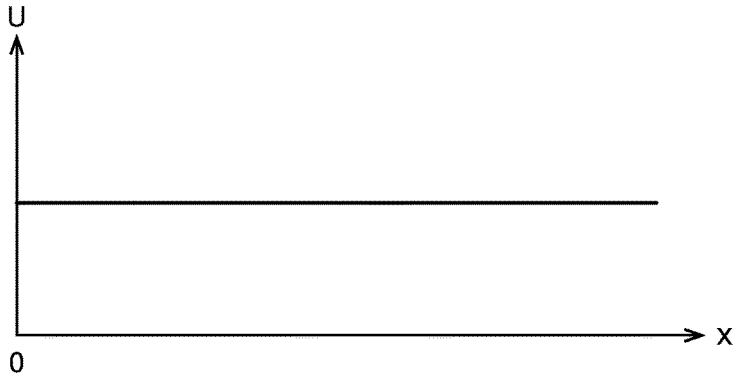
FIG. 16A qualitatively depicts the relationship between the distance (x) on the circumferential downstream side from the rim spouting port in the water passageway close to the downstream side of the rim spouting port and the height dimension (U) of the overhang portion in a flush toilet according to a second embodiment of the invention.

Also, FIG. 16A qualitatively depicts the relationship between the distance (x) on the circumferential downstream side from the rim spouting port in the water passageway close to the downstream side of the rim spouting port and the height dimension (U) of the overhang portion in a flush toilet according to a second embodiment of the invention.

Figure 16B:
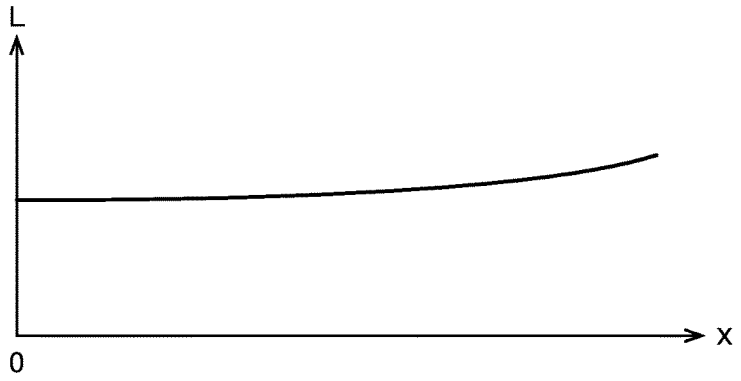
FIG. 16B qualitatively depicts the relationship between the distance (x) on the circumferential downstream side from the rim spouting port in the water passageway close to the downstream side of the rim spouting port, and the maximum height dimension (L) from the shelf surface to the bottom edge of the overhang portion, in a flush toilet according to a second embodiment of the invention.

In addition, FIG. 16B qualitatively depicts the relationship between the distance (x) on the circumferential downstream side from the rim spouting port in the water passageway close to the downstream side of the rim spouting port, and the maximum height dimension (L) from the shelf surface to the bottom edge of the overhang portion, in a flush toilet according to a second embodiment of the invention.

Figure 16C:
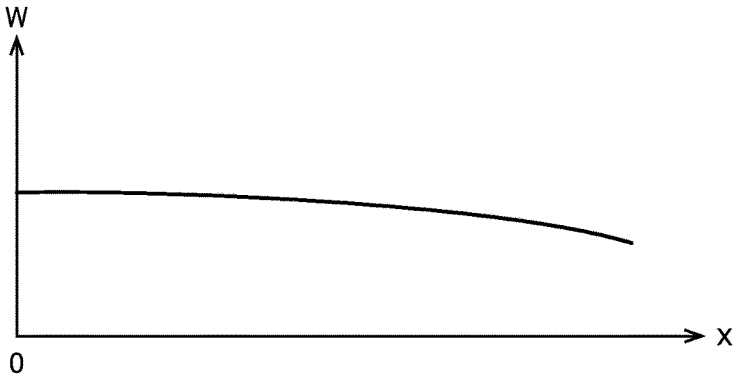
FIG. 16C qualitatively depicts the relationship between the distance (x) on the circumferential downstream side from the rim spouting port in the water passageway close to the downstream side of the rim spouting port and the width (W) of the water passageway on the downstream side of the rim spouting port, in a flush toilet according to a second embodiment of the invention.

Also, FIG. 16C qualitatively depicts the relationship between the distance (x) on the circumferential downstream side from the rim spouting port in the water passageway close to the downstream side of the rim spouting port and the width (W) of the water passageway on the downstream side of the rim spouting port, in a flush toilet according to a second embodiment of the invention.

Here, in the flush toilet according to the second embodiment of the invention shown in FIGS. 14 through 16C, the same reference numerals are assigned to those parts which are the same as parts of the flush toilet according to the first embodiment of the invention shown in FIGS. 8 through 10C, and an explanation thereof is here omitted.

As shown in FIGS. 14 through 16C, in a flush toilet 100 according to a second embodiment of the invention, a water passageway 130 formed close to the downstream side of the rim spout port 26 forms a flow path cross section G with a rim 118 inner circumferential surface 146, a shelf surface 116 formed on the lower side of this rim 118 inner circumferential surface 146, and an overhang portion 148 formed on the top side of the inner circumferential surface 46.

Also, regarding the water passageway 130, the maximum height dimension L of the flow path cross section G is set to increase with distance on the downstream side, and the width W of the flow path cross section G is set to decrease with distance on the downstream side, so that the cross sectional area A0 of the flow path cross section G is approximately constant from the rim spout port 26 toward the downstream side.

I.e., in a flush toilet 100 according to a second embodiment of the invention, the point whereby the height position P101 of the overhang portion 148 forming the flow path cross section G of the water passageway 130 close to the downstream side of the rim spout port 26 is formed at an approximately constant height position, from the rim spout port 26 toward the downstream side differs from a structure in which the height position P1 of the shelf surface 16 forming the flow path cross section G of the water passageway 30 in the flush toilet 1 according to the first embodiment of the invention is formed at an approximately constant height position, from the rim spout port 26 toward the downstream side.

Note that "approximately constant height position" means not only completely constant, but also approximately constant, whereby rim spout water passing through the flow path cross section of the water passageway 130 on the downstream side of the rim spouting port 26 after being spouted from the rim spouting port 26 is able to flow to the downstream side along the inside of the water passageway 130 with turbulence suppressed, and is able to effectively form a stable circulating flow inside the bowl on the downstream side.

Also, as shown in FIGS. 14 through 16C, in the water passageway 130 of the flush toilet 100 according to a second embodiment of the invention, the maximum height dimension L of the flow path cross section G is set to increase with distance on the downstream side, and the width W of the flow path cross section G is set to decrease with distance on the downstream side, so that the cross sectional area A0 of the flow path cross section G is approximately constant from the rim spout port 26 toward the downstream side.

I.e., regarding the minimum thickness U (U101, U102) in the vertical direction of the overhang portion 148 of the water passageway 130 shown in FIGS. 14 and 15, for example, an approximately constant thickness setting (U=U101=U102) is used so that the cross sectional area A0 of the flow path cross section G (G101, G102) is approximately constant.

Also, the maximum height dimension L102 in the vertical direction of the water passageway 130 in the flow path cross section G102 shown in FIG. 15 is set to be larger than the maximum height dimension L101 in the vertical direction of the flow path cross section G101 of the water passageway 130 shown in FIG. 14, so that the cross sectional area A0 of the flow path cross section G is approximately constant.

Furthermore, the width 102 of the water passageway 130 of the flow path cross section G102 shown in FIG. 15 is smaller than the width W101 of the water passageway 130 with the flow path cross section G101 of the water passageway 130 shown in FIG. 14, so that the cross sectional area A0 of the flow path cross section G is constant.

With the flush toilet 100 of the above-described second embodiment of the invention, the height position P101 of the overhang portion 148 forming the flow path cross section G of the water passageway 130 formed on the downstream side of the rim spout port 26 is formed at a constant height position from the rim spout port 26 toward the downstream side, the water passageway 130 flow path cross section G maximum height dimension L is set to increase with distance on the downstream side, and the water passageway 130 width W is set to decrease with distance on the downstream side, therefore rim spout water passing through the water passageway 130 flow path cross section G on the downstream side of the rim spout port 26 after being spouted from the rim spout port 26 is able to flow to the downstream side along the inside of the water passageway 130 with turbulence suppressed, and to effectively form a stable circulating flow on the downstream side.

With flush water spouted from the rim spouting port 26, a stable flow can be formed on the downstream side matching the water passageway 130 on the downstream side thereof, thereby preventing flush water from splashing, so that bowl 20 visibility and cleanability can be more effectively improved.

Figure 17:
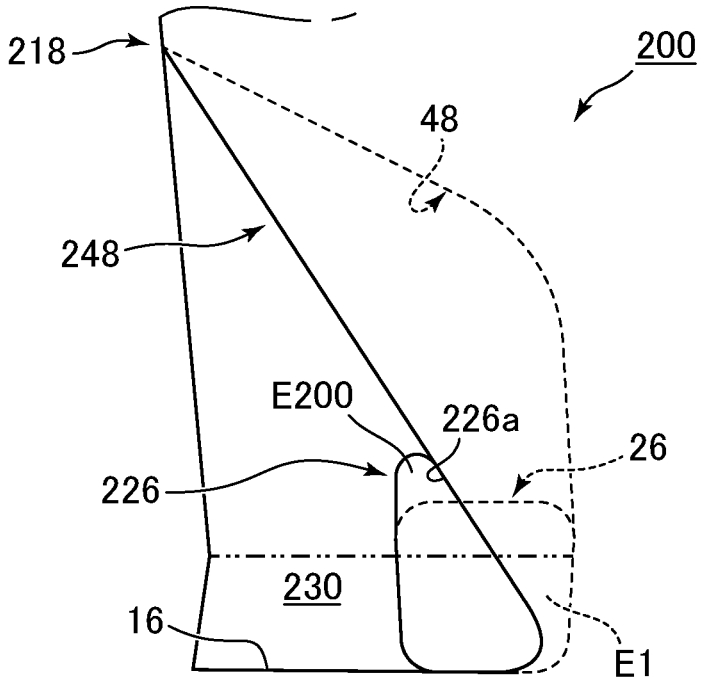
FIG. 17 is a summary cross section summarizing the lateral cross section part (the rim spouting port and the flow path cross section part of the water passageway on the downstream side thereof) close to the rim spout port in a flush toilet according to a third embodiment of the invention.

Next, referring to FIG. 17, a flush toilet according to a third embodiment of the invention is explained.

FIG. 17 is a summary cross section summarizing the lateral cross section part (the rim spouting port and the flow path cross section part of the water passageway on the downstream side thereof) close to the rim spout port in a flush toilet according to a third embodiment of the invention.

Here, in the flush toilet according to the third embodiment of the invention shown in FIG. 17, the same reference numerals are assigned to those parts which are the same as parts of the flush toilet main unit according to the first embodiment of the invention, and an explanation thereof is here omitted.

Note that in FIG. 17, as a comparative example to the flush toilet 200 according to the third embodiment of the invention, the shape of the rim spout port 26 and the overhang portion 48 in a flush toilet 1 according to the first embodiment of the invention is shown by a dotted line.

As shown in FIG. 17, in the flush toilet 200 according to a third embodiment of the invention, the opening cross section E200 of the rim spout port 226 is formed in a triangular shape; the sloped side 226*a*, which is one side on the overhang portion 248-side of this triangular rim spout port 226, forms a part of the overhang portion 248.

Thus in the rim spout port 226 of a flush toilet 200 according to a third embodiment of the invention, compared to the rim spout port 26, in which the opening cross section E1 in the flush toilet 1 according to the first embodiment of the invention shown in FIG. 17 is formed in a rectangular shape, and has essentially the same width as the opening cross section E200 of the triangular rim spout port 226 in a flush toilet 200 according to the third embodiment of the present invention, for example, the region of the overhang portion 248 above the water passageway 230 on the downstream side of the rim spout port 226 in the flush toilet 200 according to the third embodiment of the invention can be made smaller than the region of the overhang portion 48 above the water passageway 30 on the downstream side of the 26 in the flush toilet 1 according to the first embodiment of the invention.

With a flush toilet 200 according to the above-described third embodiment of the invention, forming the rim spout port 226 opening cross section E200 in a triangular shape enables the region of the overhang portion 248 above the water passageway 230 on the downstream side of the rim spout port 226 to be made small, and enables rim spout water passing through the flow path cross section of the water passageway 230 on the downstream side of the 226, after being spouted from the rim spout port 226, to flow to the downstream side along the inside of the water passageway 230 with turbulence suppressed, and to even more effectively form a stable circulating flow on the downstream side.

With flush water spouted from the rim spouting port 226, a stable flow can be formed on the downstream side matching the water passageway 230 on the downstream side thereof, thereby preventing flush water from splashing, so that bowl visibility and cleanability can be even more effectively improved.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A flush toilet for discharging waste with flush water supplied from a flush water source, the flush toilet comprising:

a bowl including a bowl-shaped waste receiving surface and a rim formed at a top edge of the waste receiving surface;

a discharge path connected at a bottom of the bowl to discharge waste;

a rim spout portion disposed on the rim, the rim spout portion being configured to spout the flush water into the bowl so as to form a circulating flow; and a water conduit configured to supply the flush water supplied from the flush water source to the rim spout portion;

wherein the bowl includes a front region on a front side relative to a center line and a rear region on a rear side relative to the center line, the center line being extending in a left-right direction to equally divide the bowl in the front-rear direction; and wherein the rim spout portion includes a rim water passageway on the rim at either a left side or a right side within the front region of the bowl so as to pass the flush water supplied from the water conduit; and a rim spout port at a downstream end of the rim water passageway so as to spout the flush water rearward; and wherein a water passageway formed on a rear side and a downstream side of the rim spouting port forms a flow path cross section with an inner circumferential surface of the rim, a shelf surface formed under the inner circumferential surface, and an overhang portion formed over the inner circumferential surface; and wherein a height dimension of the flow path cross section of the water passageway is set to increase with a downstream side distance from the rim spout port, and a width of the flow path cross section of the water passageway is set to decrease with the downstream side distance from the rim spout port, so that the cross sectional area of the flow path cross section of an intermediate section before a downstream end of the water passageway is approximately constant from the rim spout port toward the downstream side.

2. A flush toilet for discharging waste with flush water supplied from a flush water source, the flush toilet comprising:

a bowl including a bowl-shaped waste receiving surface and a rim formed at a top edge of the waste receiving surface;

a discharge path connected at a bottom of the bowl to discharge waste;

a rim spout portion disposed on the rim, the rim spout portion being configured to spout the flush water into the bowl so as to form a circulating flow; and a water conduit configured to supply the flush water supplied from the flush water source to the rim spout portion;

wherein the bowl includes a front region on a front side relative to a center line and a rear region on a rear side relative to the center line, the center line being extending in a left-right direction to equally divide the bowl in the front-rear direction; and wherein the rim spout portion includes a rim water passageway on the rim at either a left side or a right side within the front region of the bowl so as to pass the flush water supplied from the water conduit; and a rim spout port at a downstream end of the rim water passageway so as to spout the flush water rearward; and wherein a water passageway formed on a downstream side of the rim spouting port forms a flow path cross section with an inner circumferential surface of the rim, a shelf surface formed under the inner circumferential surface, and an overhang portion formed over the inner circumferential surface; and wherein a height dimension of the flow path cross section of the water passageway is set to increase with a downstream side distance from the rim spout port, and a width of the flow path cross section of the water passageway is set to decrease with the downstream side distance from the rim spout port, so that the cross sectional area of the flow path cross section of an intermediate section before a downstream end of the water passageway is approximately constant from the rim spout port toward the downstream side;

wherein the shelf surface forming the flow path cross section is formed so that a height position of the shelf surface is at an approximately constant height position from the rim spouting port toward the downstream side.

3. The flush toilet according to claim 1, wherein the overhang portion forming the flow path cross section is formed so that a height position of the overhang portion is at an approximately constant height position from the rim spouting port toward the downstream side.

4. The flush toilet according to claim 1, wherein a ratio (U:L) of a minimum height dimension (U) of the overhang portion in the flow path cross section to the maximum height dimension (L) from the shelf surface to a bottom edge of the overhang portion is set between 1:6 and 6:1.

5. The flush toilet according to claim 1, wherein a cross section of the rim spouting port is formed in a triangular shape, and one side of the triangular shape of the rim spouting port forms the overhang portion.

6. The flush toilet according to claim 2, wherein the overhang portion forming the flow path cross section is formed so that a height position of an upper end of an upper end of the overhang portion is at an approximately constant height position from the rim spouting port toward the downstream side.

7. The flush toilet according to claim 2, wherein a ratio (U:L) of a minimum height dimension (U) of the overhang portion in the flow path cross section to the maximum height dimension (L) from the shelf surface to a bottom edge of the overhang portion is set between 1:6 and 6:1.

8. The flush toilet according to claim 2, wherein a cross section of the rim spouting port is formed in a triangular shape, and one side of the triangular shape of the rim spouting port forms the overhang portion.

* * * * *